United States Patent [19]

Beyl

[11] 4,383,699

[45] May 17, 1983

[54] RETRACTABLE SKI BRAKE

[75] Inventor: Jean J. A. Beyl, Nevers, France

[73] Assignee: Ste Look, Nevers, France

[21] Appl. No.: 217,006

[22] PCT Filed: Mar. 20, 1980

[86] PCT No.: PCT/FR80/00040

§ 371 Date: Nov. 27, 1980

§ 102(e) Date: Nov. 24, 1980

[87] PCT Pub. No.: WO80/01988

PCT Pub. Date: Oct. 2, 1980

[30] Foreign Application Priority Data

Mar. 27, 1979 [FR] France ..... 79 07598

[51] Int. Cl.[3] ..... A63C 7/10

[52] U.S. Cl. ..... 280/605

[58] Field of Search ..... 280/605, 604

[56] References Cited

U.S. PATENT DOCUMENTS

| | | | |
|---|---|---|---|
| 3,989,271 | 11/1976 | Riedel | 280/605 |
| 4,101,145 | 7/1978 | Korger | 280/605 |
| 4,123,083 | 10/1978 | Riedel | 280/605 |
| 4,124,223 | 11/1978 | Kubelka | 280/605 |
| 4,194,758 | 3/1980 | Svoboda et al. | 280/605 |
| 4,234,206 | 11/1980 | Hofbauer et al. | 280/605 |
| 4,294,458 | 10/1981 | Sedlmayr | 280/605 |

FOREIGN PATENT DOCUMENTS

| | | |
|---|---|---|
| 2318658 | 2/1977 | France . |
| 2388572 | 11/1978 | France . |

*Primary Examiner*—David M. Mitchell
*Assistant Examiner*—Milton L. Smith
*Attorney, Agent, or Firm*—Jordan B. Bierman; Linda Bierman

[57] ABSTRACT

A retractable ski brake includes a pair of pivoted brake arms disposed symmetrically on either side of the ski and freely journaled on the ski top surface in bearings, the operative ends of the brake arms being adapted to be raised and retracted inwards of the ski so as not to protrude from the side edges thereof when inoperative. The opposite ends of these arms are interconnected by hinge means through a flexible, suitably shaped portion of the same metal wire constituting the brake arms. A strap fastened to clamps rotating about these opposite ends forms a control pedal, and the hinge means is anchored to one end of resilient return means normally urging the brake arms to their operative position and the control pedal to its raised position, these positions being obtained when the ski boot is lifted off the ski.

6 Claims, 12 Drawing Figures

FIG. 1
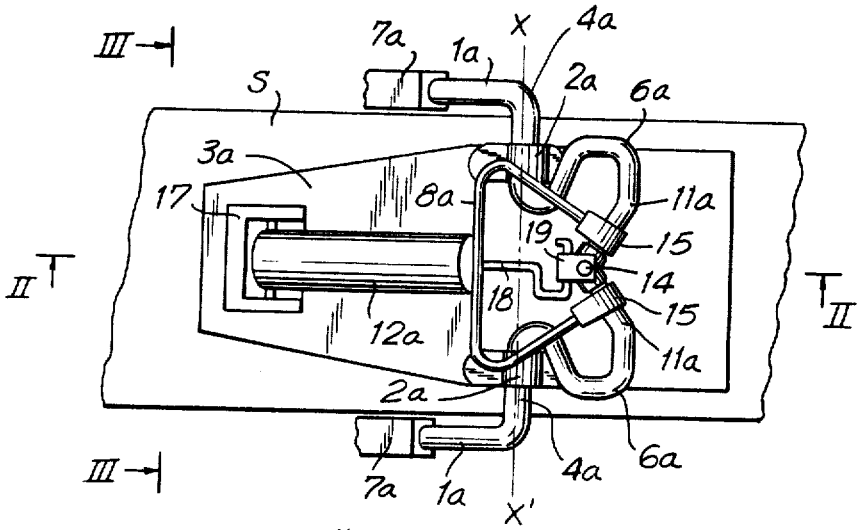
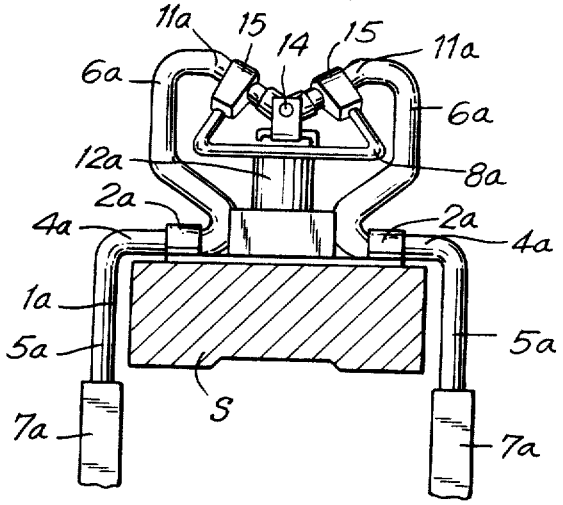
FIG. 3

FIG. 4
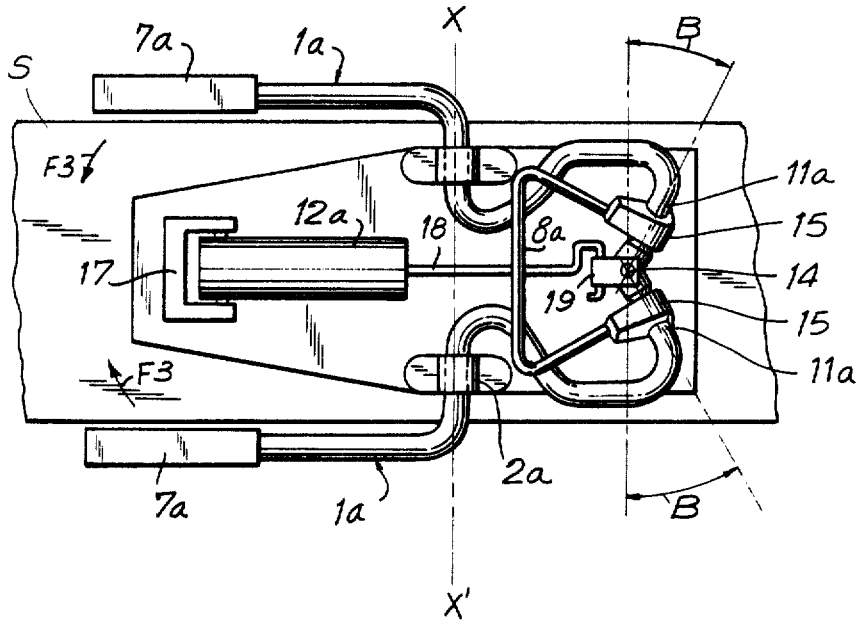
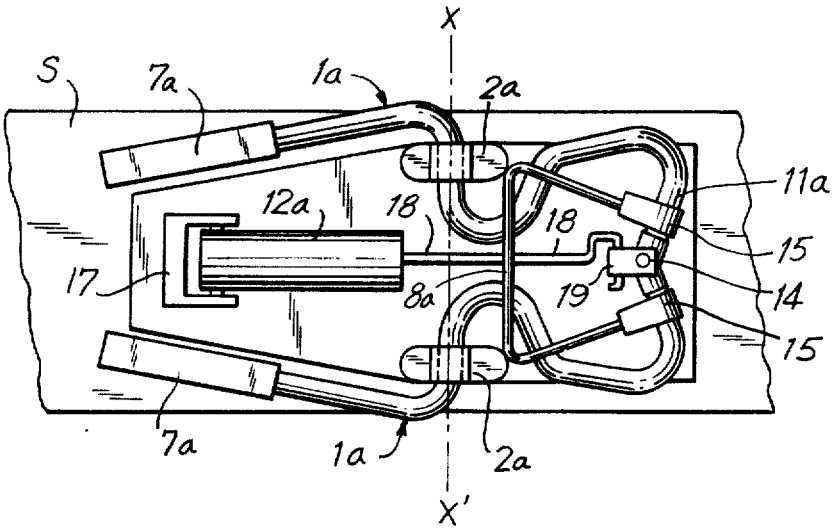
FIG. 5

FIG. 6
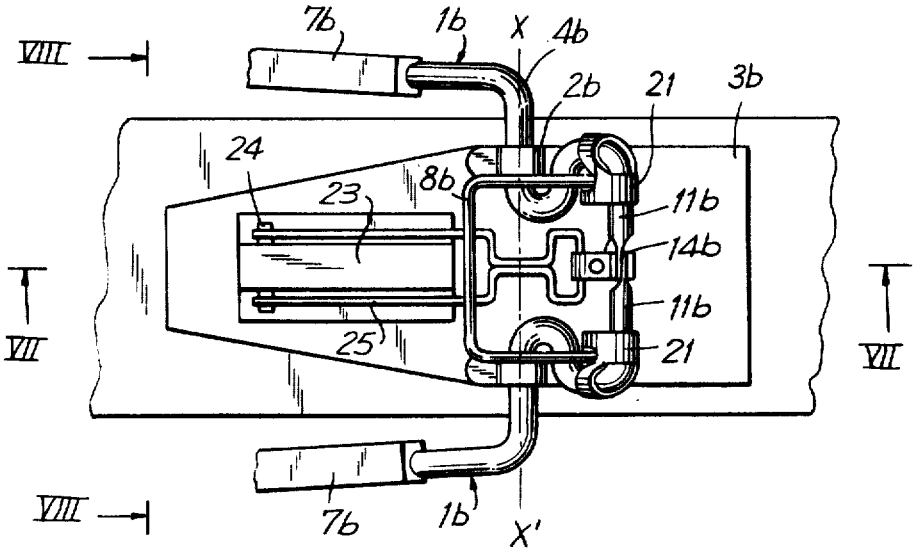
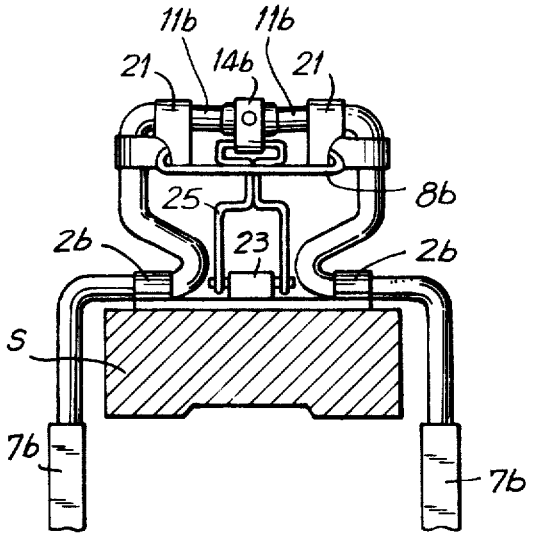
FIG. 8

FIG. 9
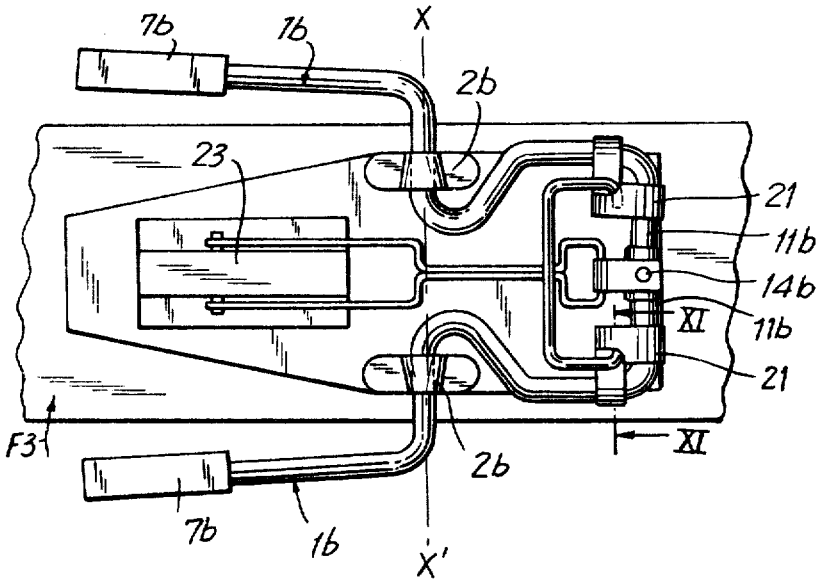
FIG. 11
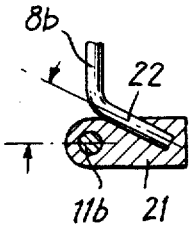
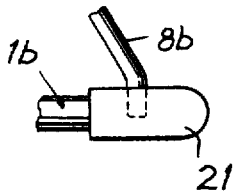
FIG. 12
FIG. 10
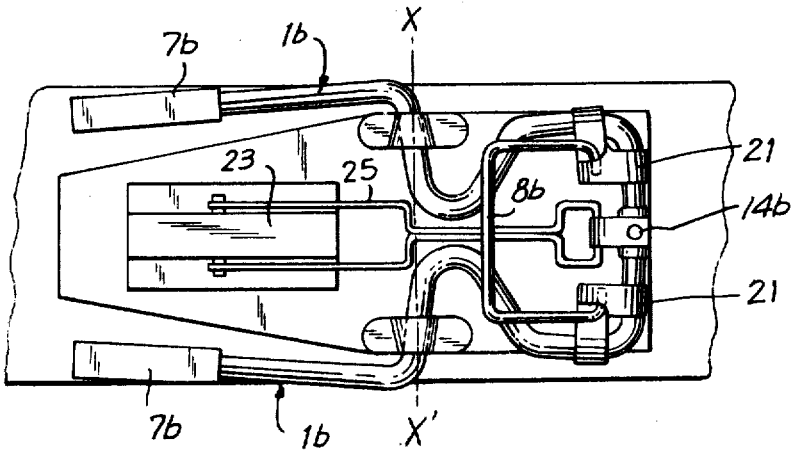

RETRACTABLE SKI BRAKE

BACKGROUND OF THE INVENTION

The present invention relates in general to ski brakes and notably to ski brakes of the type comprising brake shoes which, when retracted to their inoperative position, are flush with the ski side edges.

DESCRIPTION OF THE PRIOR ART

The most popular ski brakes comprise a pair of pivoting brake arms disposed on either side of the ski and pivotally mounted thereon about a transverse axis. At one end, these two arms are interconnected by a cross member acting as a control pedal, and a return spring constantly urges the two arms to their operative position in which their ends opposite said one end are lowered in relation to the ski bottom surface so as to penetrate into the underlying snow layer. Ski brakes of this character are made as a rule from metal wire and the transverse pivot axis may consist in this case of a pair of elbows formed in the two pivoting brake arms, respectively.

When the ski boot is positioned on the ski it exerts a pressure on the control pedal, thus holding the operative portions of the brake arms in their raised, retracted position. However, the operative portions of these arms project laterally beyond the side edges of the ski, and this may constitute a serious drawback under certain circumstances.

Therefore, certain known ski brakes are so designed that the operative portions of their pivoting arms are moved towards each other above the ski top when they are raised to their retracted position. Various systems have been proposed for retracting the pivoting brake arms to this recessed position.

Thus, in French patent application No. 75 07899, published under No. 2,272,695, the brake arms are retracted by tensioning the metal wire constituting said arms, and by providing tension means in the form of a knee-action or over-center device adapted to be flattened by the boot pressure. However, the operation of this known system is not fully reliable for a relatively great force must be exerted to alter the shape of the metal wire constituting the brake arms. In fact, this wire must on the other hand have a rigidity sufficient to exert an efficient braking action and prevent the brake arms from being distorted when simple shocks are exerted thereon.

In another French patent application, No. 76 11752 published under No. 2,308,389, the brake arms are retracted to their raised position by exerting a pressure on a deformable plate or hinged quadrilateral disposed beneath the boot location so as to be flattened by the ski boot when the latter is fitted in position. The arrangement is such that the flattening of the plate or hinged quadrilateral is attended by the movement of the two brake arms toward each other after said arms have been raised to their retracted position.

However, if the control plate consists of a curved blade, the latter will exert a relatively strong pressure against the boot sole. This is likely to interfere with the boot release conditions when the safety ski binding associated with this boot is actuated, for example in case of a skier's fall. Besides, if the control plate consists of a hinged quadrilateral, the system contemplated is particularly complicated an expensive. Moreover, this system appears to be scarcely reliable inasmuch as its operation is likely to be impaired in case of icing.

In a further French patent application, No. 75 34137 published under No. 2,330,419, the brake arms are retracted by the action of one or a plurality of cam faces possibly carried by an auxiliary pedal. But in this case the solutions contemplated are not fully satisfactory. In fact, since the pivot brake arm retraction is obtained by elastic deformation of the metal wire constituting said arms, a relatively great effort must be exerted thereon for this purpose. Moreover, this system also produces parasitic stress interfering with the ski boot release conditions in case of actuation of the safety ski binding.

On the other hand, to avoid excessive over-all dimensions, the height of the control cam faces or ramps must be kept within reasonable limits, thus limiting the amplitude of the retraction movement of the pivot brake arms.

In a further proposal, the retraction movement of the brake arms can be obtained by causing these arms to pivot in bearings of which the axis, disposed in a plane transverse to the ski axis, is inclined with respect to the longitudinal center line of the ski (cf. FIG. 11 of French patent application No. 73 17074 published under No. 2,228,506). An advantage deriving from this system is its extreme simplicity. But, on the other hand, it is objectionable in that the slightest distortion of the brake arm may cause the latter to rub the ski edge and possibly be jammed thereby, since the retraction movement of the brake arm takes place simultaneously with its upward movement. Another drawback lies in the fact that to obtain a sufficient degree of retraction the pivot bearing must be located at a relatively high level, a requirement that cannot be met if the brake is to be disposed under the ski boot.

Therefore, all of the various systems proposed up to now in the art for recessing the brake arms are attended by serious inconveniences. It is for this reason that the present invention is directed to a ski brake in which the brake arms are retracted automatically by using particularly simple, reliable and economical means adapted to be easily operated while exerting a negligible thrust against the ski boot sole.

The ski brake according to the present invention is characterized in that the ends of the pivoting brake arms which are opposite to their operative portions are interconnected directly by a pivot pin or a flexible connecting portion, and that the control pedal is pivoted to the portions of said arms which extend between said pivot pin or flexible connecting portion and the pivoted portion of each arm. Moreover, said opposite, interconnected ends of said brake arms are inclined in opposite directions with respect to a line perpendicular to the ski axis and parallel to the top surface of the ski. When the operative portions of the brake arms have been raised as a consequence of the pressure exerted by a ski boot on their opposite ends, the folding back of the control pedal against the ski top is attended by the movement of the operative portions of the brake arms toward each other above the ski top.

The arrangement is such that the pivotal movement of the control pedal in relation to said brake arms is attended by a variation in the relative spacing of said operative portions of the brake arms and consequently by the recessing of said operative portions to their retracted position. Thus, when the brake arms are retracted and the control pedal is pressed against the ski top surface, the operative portions of the brake arms are held inwardly of the ski edges. On the other hand, the upward movement of the control pedal, when the ski boot is lifted off the ski, is attended automatically by a divarication of said operative portions of the brake arms to an extent sufficient to enable said portions to freely clear the ski on either side thereof.

A clearer understanding of the mode of operation of the ski brake of the present invention will be had as the following description proceeds with reference to the accompanying drawings illustrating diagrammatically typical forms or embodiments of the invention, given by way of illustration, not of limitation.

THE DRAWINGS

FIG. 1 is a plan view from above showing a first embodiment of a ski brake according to this invention in its operative or braking position;

FIGS. 2 and 3 are a longitudinal section taken along line II—II and a cross-section taken along line III—III, respectively, of FIG. 1;

FIGS. 4 and 5 are views similar to FIG. 1 but showing the same brake in an intermediate position, with the brake arms simply raised above the snow surface, and with the brake arms fully retracted, respectively;

FIG. 6 is a plan view from above showing a second embodiment of the ski brake of this invention in its operative or braking position;

FIGS. 7 and 8 are sectional and elevational views taken along the lines VII—VII and VIII—VIII, respectively, of FIG. 6;

FIGS. 9 and 10 are views similar to FIG. 6, but showing the same brake in an intermediate position with the brake arms simply raised, and in a fully retracted position, respectively;

FIG. 11 is a detail view in section along the line XI—XI of FIG. 9; and

FIG. 12 is a side elevational view of the same detail.

DESCRIPTION OF THE PREFERRED EMBODIMENTS

Figure 2:
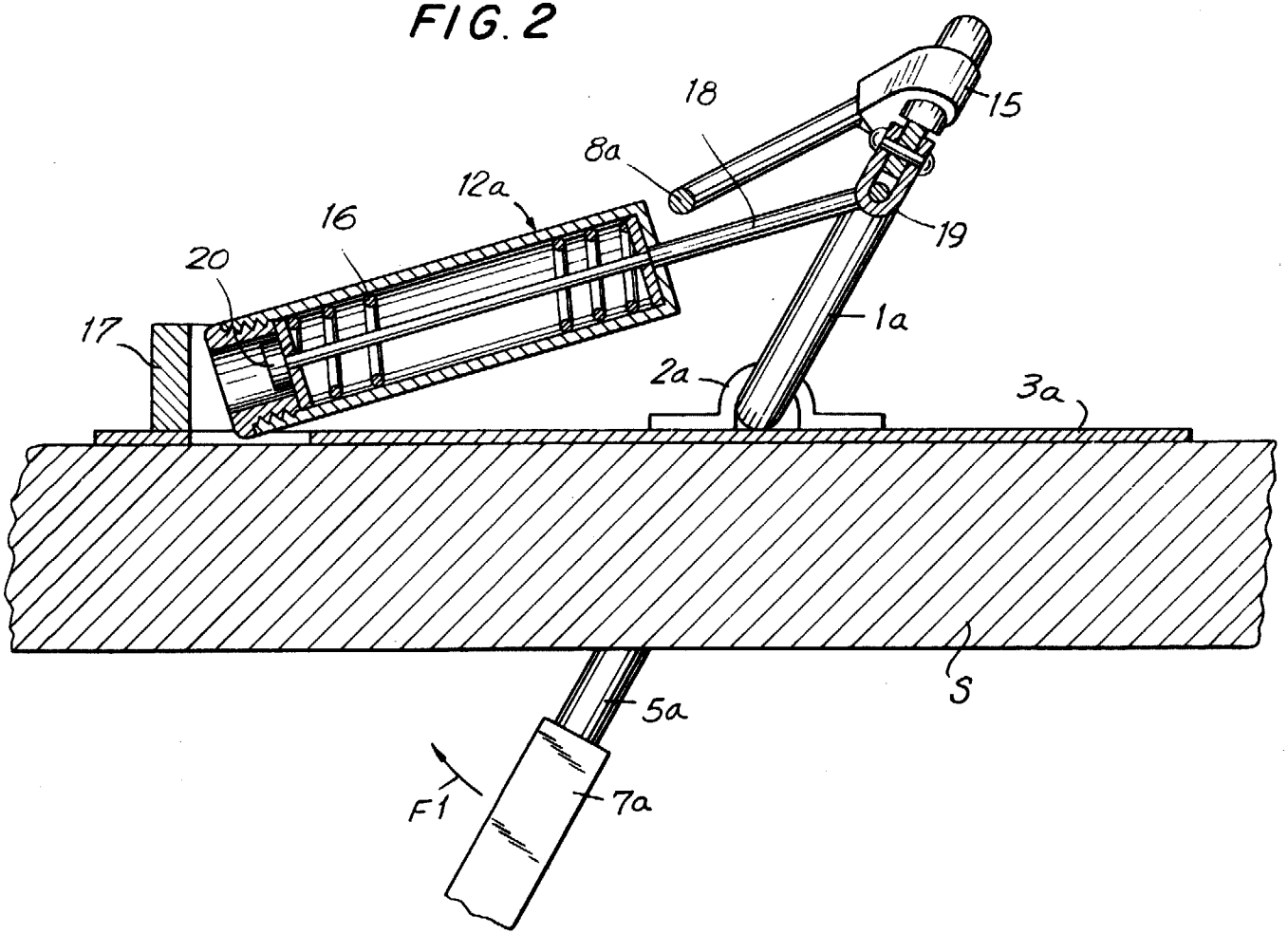

The ski brake illustrated in FIGS. 1 to 5 of the drawings comprises a pair of pivoting brake arms 1*a* made of rigid metal wire and adapted to be disposed on one and the other side of the corresponding ski S. These arms are journaled in a pair of spaced bearings 2*a* carried by a mounting plate 3*a* adapted to be fastened to the top surface of the ski in a position such that the common axis xx' of these bearings extends across the longitudinal center line of the ski.

The pivoting brake arms 1*a* are disposed symmetrically and the pivot axis of each arm consists of a pivot-forming bent portion 4*a* journaled in the corresponding bearing 2*a*. In this respect, it will be noted that the bearings 2*a* are so dimensioned that the pivot pins 4*a* are relatively free therein.

The pivot-pin forming portion 4*a* of each arm 1*a* defines in the latter two separate portions, namely an operative portion 5*a* adapted to penetrate into the snow in the braking position and a control portion 6*a* adapted to be depressed by the ski boot when the latter is fitted in position. Due to their pivotal mounting, these two arms 1*a* can assume two different end positions, namely a waiting position in which the operative portions 5*a* thereof are retracted above the ski top and an operative or braking position in which the same portions project beneath the bottom surface of the ski (see FIG. 1). preferably, the outer ends of the operative portions of the brake arms are provided with brake shoes 7*a* adapted to penetrate into the snow layer to improve the braking efficiency of the device.

The ends 11*a* of these arms which are opposite the brake shoes are interconnected directly through a pivot pin 14 somewhat in the fashion of a pair of compass legs. The movements of said arms toward and away from each other are controlled by a brake pedal which engages the control portions 6*a* of the brake arms.

In the example illustrated in FIGS. 1 to 5, the brake pedal consists of a strap 8*a* of metal wire having its ends rigidly inserted in sleeves 15 rotatably mounted on the corresponding ends 11*a* of the pivoting brake arms. In this respect, it may be seen that these ends 11*a*, constituting the pivot means of the control pedal 8*a*, are inclined in opposite directions with respect to a line perpendicular to the ski axis and parallel to the top surface of the ski. Thus, in the intermediate position in which the brake arms are simply raised, before the brake shoes are retracted (see FIG. 4), the axes of said ends 11*a* form an angle $\beta$ with respect to a transverse line intersecting said axis, the vertex of the angle formed by said axes being directed toward the brake shoes 7*a*. Finally, a resilient return device 12*a* is provided for the dual purpose of urging the pivoting arms 1*a* to their operative position shown in FIG. 1 and holding the pedal 8*a* in its raised position illustrated in the same Figure. The resilient return device 12*a* comprises a coil compression spring 16 enclosed in a cylinder having one end pivoted to a bracket 17 secured to the mounting plate 3*a*, the other end receiving therethrough a sliding rod 18 attached to the pivot pin 14 by means of a strap 19. At its inner end this sliding rod 18 carries a piston 20 engaging the inner end of spring 16. The advantageous feature characterizing the resilient return device 12*a* is that it operates both ways, so that it can act as a double-acting shock-absorber adapted to damp out shocks directed either forward or backward when the pedal is in its operative position.

The above-described ski brake operates as follows:

When the ski boot is fitted in position the pressure exerted thereby on control pedal 8*a* and the upper ends 11*a* of the brake arms firstly causes the latter to pivot in the direction of the arrow F1 (FIG. 2) to the simply raised position shown in FIG. 4. However, when the boot is applied against the ski top surface the pressure thus exerted subsequently causes the control pedal 8*a* to pivot in the opposite direction so that it also bears on the ski top surface.

During this downward pivotal movement, the control pedal 8*a* pivots on the relevant portions 6*a* of the brake arms about axes formed by the ends 11*a* thereof. However, since these ends are inclined in opposite directions in relation to a line perpendicular to the longitudinal axis of the ski, the pivotal movement of the pedal is attended by a pivotal movement of arms 1*a* in the opposite direction, as shown by the arrow F3 (FIG. 4), about their junction pivot pin 14, somewhat in the fashion of the two legs of a compass.

The pair of brake shoes 7*a* are thus moved towards each other above the ski and eventually, when the control pedal 8*a* has been depressed home, the brake shoes 7*a* of the two pivoting brake arms are retracted to a position inwardly of, and above, the ski, as illustrated in FIG. 5. Under these conditions, not a single portion of the ski brake projects beyond the ski edges.

Figure 7:
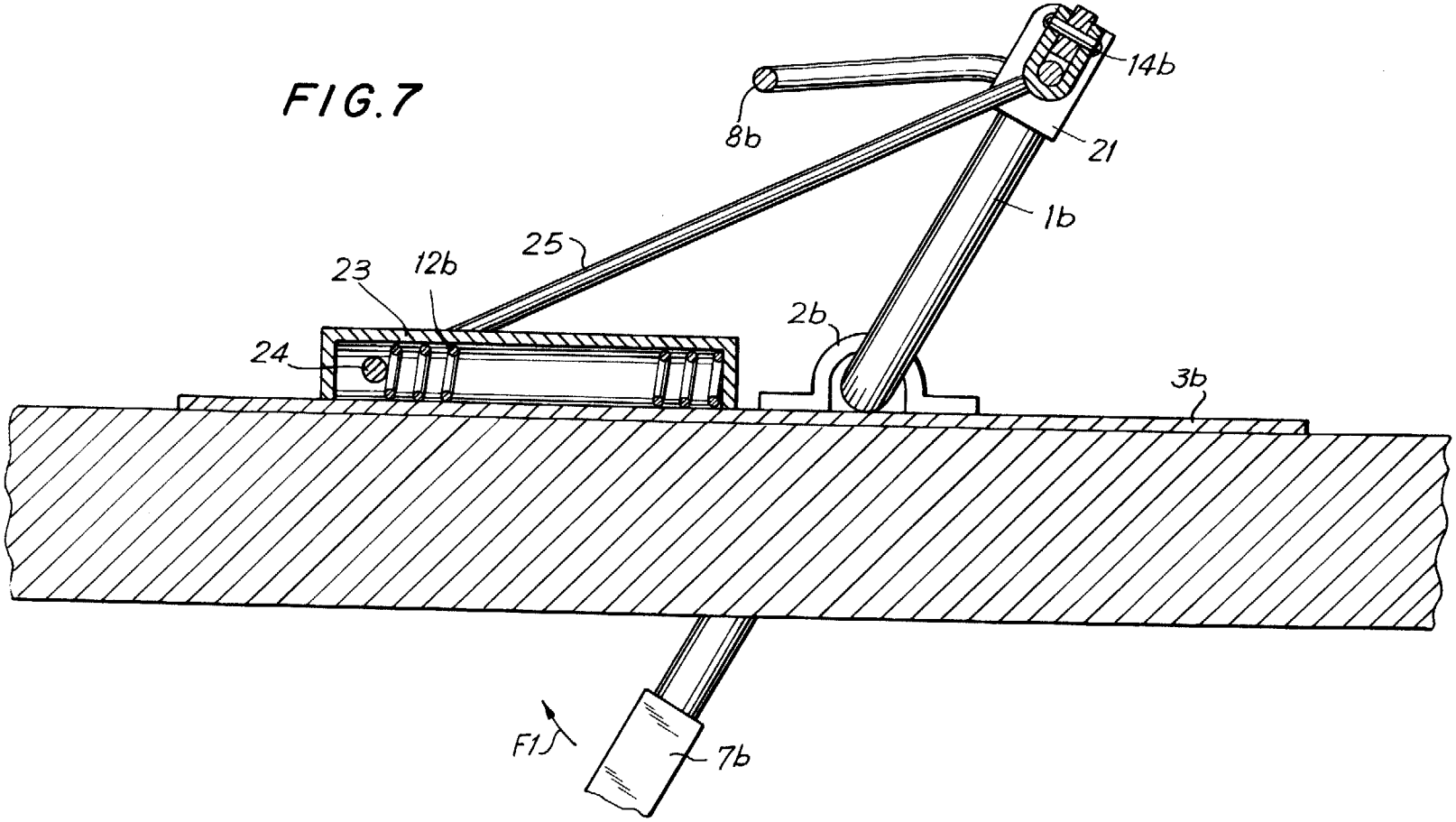

FIGS. 6 to 12 of the drawings illustrate another form or embodiment of the ski brake of this invention. In these Figures, the component elements corresponding to certain elements of the first embodiment are designated by the same reference numerals to which the index letter "b" is added in lieu of index letter "a".

As in the preceding embodiment, the pivot portions 4b of brake arms 1b are journaled with a predetermined clearance in the pair of bearings 2b carried by the base or mounting plate 3b. In addition, the ends 11b of these arms, which are opposite the brake shoes 7b, are interconnected by means of a pivot pin 14b in the fashion of the two legs of a compass.

Furthermore, the control pedal consists of a strap 8b made of metal wire, the ends of this strap being pivoted in clamps 21 fitted to the ends 11b of brake arms 1b. In this respect, it will be seen that the ends 22 of the strap constituting the control pedal 8b are bent to form an obtuse angle with respect to each other (see FIG. 11) and are adapted to pivot about their axes in bores formed at the proper angle in the relevant clamps 21.

The two pivot pins thus formed are inclined in opposite directions and form a V in a plane across the ski.

The resilient return means provided in this alternate embodiment comprises a coil compression spring 12b (FIG. 7) enclosed in a cylindrical case 23 carried by the mounting base plate 3b. The front end of this spring is engaged by a sliding cross tie 24 interconnecting the outer ends of the two arms of a traction strap 25 of which the opposite end is anchored to the pivot pin 14b of the pair of brake arms. Thus, this resilient return means will constantly urge the brake arms 1b to their operative position and the control pedal 8b to its raised position.

This brake assembly operates like the one previously described. In fact, when fitting the ski boot in position, the pressure exerted thereby on control pedal 8b and the upper ends 11b of the pair of brake arms first causes the pivotal movement of these arms in the direction of the arrow F1 to their simply raised position, and then causes the control pedal 8b to pivot in the opposite direction so as to press the same against the ski top surface. This last-mentioned movement causes the brake arms 1b to move toward each other by pivoting (as shown by the arrows F3) about their common pivot pin 14b. When the control pedal 8b has been folded down completely for engagement with the ski, the brake shoes 7b are moved toward each other above the ski—i.e. to the position shown in FIG. 10—thus avoiding any protrusion of said shoes beyond the ski edges.

Thus, in both embodiments disclosed hereinabove the pair of brake arms are pivoted to each other in the fashion of the two legs of a compass and the movement of these arms toward each other is obtained by simply folding down the control pedal pivoted for this purpose on the two about two axes inclined in opposite directions in relation to a line perpendicular to the ski axis and parallel to the surface of the ski.

However, if desired the common pivot axis of the two brake arms could be replaced by a simple connecting area between the corresponding ends of said arms, said area being shaped to have the necessary flexibility and elasticity.

On the other hand, it is not compulsory that the pivot points for the ends of the strap constituting the control pedal 8a or 8b be located in close proximity to the upper ends of the brake arms. In fact, it is only necessary that the pivot means for the control pedal be located on the control portions of the brake arms which are positioned beyond the pivot portions 4a or 4b. In any case, the control pedal pivot means could if desired by disposed in close proximity of bearings 2a or 2b.

The resilient return means could also be of a type other than that described hereinabove. On the other hand, one of the resilient return means for a given embodiment may of course be used in, and/or adapted for, another or different embodiment. It is also possible to provide two separate resilient return means, one for pivoting the brake arms about their pivot axes, the other for rotating the control pedal about its pivot means.

Preferably, the ski brake according to the present invention is to be fitted between the toe and heel devices of a safety ski binding. Certain component elements of this ski brake, notably the control pedal, may be lined with antifriction material such as polytetrafluoroethylene (Teflon) in order to facilitate its sliding contact with the ski boot during boot release as a consequence of the ski binding actuation. However, the ski brake according to the instant invention may also be incorporated in the ski binding proper, if desired.

Having thus described the invention, what is claimed is:

1. A retractable ski brake comprising two pivoting brake arms adapted to be disposed on one and the other side of a ski, the operative portions of said arms being movable about bearing means between a lower braking position and a raised retracted position, the opposite ends of said arms carrying a control pedal and being responsive to resilient return means constantly urging said arms to their operative position, wherein the ends of said pivoting brake arms which are opposite said operative portions are interconnected directly through pivot means, said control pedal being pivotally mounted on the portions of said brake arms which are located between said pivot means and their bearing means, about a pair of axes inclined in opposite directions in relation to a line perpendicular to the ski axis and parallel to the top surface of the ski, whereby when the operative portions of said pivoting brake arms have been raised by the pressure exerted by the ski boot on their opposite ends, the movement of said control pedal towards the ski top surface is attended by the movement of said operative portions of said brake arms towards each other above the ski.

2. The ski brake of claim 1, wherein said control pedal is carried by a pair of sleeves rotatably mounted on two sections of the corresponding portions of said pivoting brake arms which are inclined in relation to a line perpendicular to the ski axis and parallel to the top surface of the ski.

3. The ski brake of claim 2, wherein resilient return means is provided for constantly urging said control pedal to its raised position when said pedal is released by the ski boot.

4. The ski brake of claim 3, wherein said resilient return means associated with the control pedal is also adapted to constantly urge said pivoting brake arms to their operative position.

5. The ski brake of claim 4, wherein said pivot means of said control pedal on said brake arms is located adjacent the pedal edge opposite the operative portions of said brake arms, said control pedal being adapted to pivot in a direction opposite that of said brake arms when the assembly is retracted above the ski.

6. The ski brake of claim 1, wherein said control pedal consists of a strap having its ends trunnioned in clamps carried by the corresponding portions of said pivoting brake arms, said ends and the bores engaged thereby being inclined in relation to a line perpendicular to the ski axis and parallel to the top surface of the ski.

* * * * *